US006099692A

United States Patent [19]

Weisshuhn et al.

[11] Patent Number: 6,099,692

[45] Date of Patent: Aug. 8, 2000

[54] HEADBOX TURBULENCE GENERATOR

[75] Inventors: Elmer Weisshuhn, Vogt; Ulrich Begemann; Volker Schmidt-Rohr, both of Heidenheim, all of Germany

[73] Assignee: Voith Sulzer Papiermaschinen GmbH, Germany

[21] Appl. No.: 09/110,915

[22] Filed: Jul. 6, 1998

[30] Foreign Application Priority Data

Jul. 4, 1997 [DE] Germany ..... 197 28 599

[51] Int. Cl.[7] ..... D21F 1/02

[52] U.S. Cl. ..... 162/343; 162/336

[58] Field of Search ..... 162/343, 336

[56] References Cited

U.S. PATENT DOCUMENTS

| | | | |
|---|---|---|---|
| 3,098,787 | 7/1963 | Sieber | 162/216 |
| 4,070,238 | 1/1978 | Wahren | 162/343 |
| 4,104,116 | 8/1978 | Koskimies | 162/343 |
| 4,225,386 | 9/1980 | Edblom et al. | 162/343 |
| 4,687,548 | 8/1987 | Ilmoniemi et al. | 162/216 |
| 5,110,416 | 5/1992 | Linsuri et al. | 162/343 |
| 5,316,383 | 5/1994 | Begemann et al. | 366/160 |
| 5,695,611 | 12/1997 | Bubik et al. | 162/199 |

FOREIGN PATENT DOCUMENTS

| | | | |
|---|---|---|---|
| 0300288 | 1/1989 | European Pat. Off. . | |
| 1561650 | 11/1967 | Germany . | |
| 1941424 | 2/1971 | Germany . | |
| 3039463 | 5/1983 | Germany | 162/343 |
| 3538466 | 5/1986 | Germany . | |
| 9304736 | 5/1993 | Germany . | |
| 4433445 | 3/1996 | Germany . | |
| 1213137 | 11/1970 | United Kingdom . | |

*Primary Examiner*—Karen M. Hastings

*Attorney, Agent, or Firm*—Ostrolenk, Faber, Gerb & Soffen, LLP

[57] ABSTRACT

A headbox of a paper or board machine having an inlet, a distributor for feeding stock suspension to be distributed over the machine width into the inlet. A turbulence generator downstream of the distributor has a hydraulic diameter of less than 17 mm in the downstream end region. The hydraulic diameter is the diameter of individual channels through the turbulence generator. The turbulence generator has channels or plates that define several channels, each in accordance with the desired hydraulic diameter. Dimensions of the hydraulic diameter are disclosed. The turbulence generator has lands at the downstream end. The land area ratio is disclosed. A nozzle or the like downstream of the turbulence generator introduces the stock suspension over the machine width to a wire or wires of the next section.

8 Claims, 2 Drawing Sheets

HEADBOX TURBULENCE GENERATOR

BACKGROUND OF THE INVENTION

The present invention relates to a headbox of a paper machine or board machine and more particularly to the turbulence generator in the headbox, following the transverse distributor.

A headbox in which the invention might be used is disclosed in German Patent Application DE 44 37 180 of the applicant. This headbox has a machine width transverse distributor, a turbulence generating region following downstream and supplied by the distributor and a headbox nozzle following the turbulence generating region downstream. The turbulence generating region contains a grating, a following equalization chamber and a tube bundle. The tube bundle widens stepwise in the flow direction of the stock suspension, and the tube bundle has the greatest tube diameter at the outlet end of the tube bundle. The tubes of the tube bundle turbulence generator thus have considerably smaller inlet cross sections than outlet cross sections. One reason for this is that a minimum land area must be provided on the inflow side to prevent the formation of fiber clumps and contamination. Abrupt cross-sectional widenings are provided in the tube to generate specifically desired turbulences for ensuring that the fiber flocs in the suspension are broken up. This has a positive influence on the later sheet formation.

To avoid disturbing wake effects in the following downstream nozzle, it is necessary to keep the land areas at the outlet of the tube bundle small. To satisfy the requirement for small land areas at the outlet end of the turbulence generating region, the outlet cross sections of the tube bundles are usually not circular in any headbox, but rather have a shape which permits their highest possible packing density. Because the tubes are not of circular shape in the end region of the turbulence generator, secondary flows form in the tubes, and these flows lead to disturbances which can penetrate as far as the nozzle outlet gap of the following downstream nozzle. This penetration of disturbances ultimately leads to a negative influence on the formation of the sheet, and hence to impairment of the final paper quality.

The inventors have discovered that known turbulence generating concepts cause the following typical disturbances:

1. As a consequence of secondary flows in the divergent outlet region of the tubes, transverse flows are produced, and these cannot be dissipated completely in the following nozzle. These transverse flows are reinforced by the flow deflection upstream of the slice at the nozzle outlet, and they are visible in the jet as regular furrows. A disturbed jet leads to a streaky formation of the sheet.

2. A streaky formation may likewise be produced as a consequence of demixing in the tube corners.

3. If baffles are connected downstream of the turbulence tubes, the baffles have to extend over a significant part of the flow path in order to be able to reduce the above described turbulence tube disturbances. Microturbulence, which can partly eliminate the described disturbances, is produced at the baffle surface as a result of friction between the fluid and the tube wall.

Complete elimination of the disturbances is not possible, because of the short wavelength of the microturbulence and the comparatively low energy content of these turbulent transverse movements. Although the disturbances described are further dissipated with increasing baffle length, it is disadvantageous that, because of the then increasing microturbulence, an undesirably hard, fine grained formation of the paper web is likewise produced.

In practice, the selection of the baffle length thus always constitutes a compromise between adequate elimination of disturbances, on the one hand, and the least possible negative influence on the sheet formation, on the other hand. Adequate elimination of the disturbances, which are caused by the turbulence generators which are common currently, is not possible by using baffles connected downstream. All the headboxes built nowadays therefore produce streaky disturbances of the formation under critical operating conditions.

4. In perforated roll headboxes, with perforated rolls as turbulence generators, it is necessary, for static strength reasons, for the land area of the perforated roll to be greater than about 55%. The large webs which are produced thereby cause coarse turbulence during the passage of the flow, and this turbulence often cannot decay adequately in the headbox nozzle and, as a consequence, also causes disturbances to the formation.

For single layer and multilayer headboxes, it has been shown that the disturbances in headboxes with tube bundle turbulence generators, the disturbances generated by the abrupt steps and/or by widenings of the turbulence tubes, and the disturbances which are brought about at the outlet from the perforated roll in headboxes having turbulence generators constructed as a perforated roll all cannot be reduced to an adequate extent with the currently conventional geometries of the elements which follow in the headbox. Even slight convergent widenings in one plane can lead to transverse flows which cannot be eliminated, particularly at the limits of the operating range of the headbox. This means, therefore, that the turbulence generating unit upstream of the nozzle must be dimensioned such that far fewer disturbances, in the form of stationary irregularities, are caused by this turbulence generating element.

Since the influences of disturbances which are produced by the turbulence generator are also determined to a significant extent by the dimensions of the turbulence generating passages, it is expedient to relate the configuration of a headbox to a significant extent to the hydraulic diameter of the turbulence generating region. The hydraulic diameter $d_{hydr}$ is defined as four times the total cross-sectional area through which fluid flows, divided by the length of all the edge regions which occur. In an ideal, circular cross section, this corresponds exactly to the geometric diameter of the circular area. In an infinitely long gap, the hydraulic diameter is twice the height of the gap.

SUMMARY OF THE INVENTION

It is an object of the invention to improve the foregoing headbox so that it produces a stock jet which provides the precondition for a paper or board of improved formation.

The invention relates to a headbox of a paper or board machine having an inlet and a distributor for feeding stock suspension to be distributed over the machine width into the headbox inlet. A turbulence generator located downstream of the distributor in the stock suspension flow direction has a hydraulic diameter of less than 17 mm in the outlet end region of the turbulence generator. The hydraulic diameter is defined by the diameters of individual channels through the turbulence generator and the turbulence generator has channels or plates that define several channels, each in accordance with the desired hydraulic diameter. A headbox nozzle, or the like, located downstream of the turbulence generator in the flow direction introduces the stock suspension over the machine width to a wire section or forming section of the machine.

In order to avoid disturbances to sheet formation, according to the invention, it is necessary to configure the hydraulic diameter, or the individual hydraulic diameter of the turbulence generating region, at its outlet and its transition to the headbox nozzle so that no coarse flows, which may penetrate as far as the exit from the headbox nozzle, can occur. In headboxes of known dimensioning, this means that the maximum hydraulic diameter at the outlet end of the turbulence generator must be less than 17 mm, preferably less than 14 mm, and most preferably lies in the range between 14 and 7 mm.

In a particular configuration of the invention, in any headbox, the hydraulic diameter of the turbulence generating region at its transition to the headbox nozzle is related to the gap height of the nozzle outlet gap $d_D$ by the following:

$$6\ \text{mm} \leq d_{hydr}[\text{mm}] \leq -0.52 d_D + 30,$$

where $d_D$=nozzle height at half the nozzle length [mm]·0.5.

A farther reaching inventive configuration leads to the land area ratio at the end of the turbulence generator being taken into account in addition to the maximum hydraulic diameter in the end region of the turbulence generator being determined. The land area ratio is defined as the total cross sectional area at the end of the turbulence generator $F_{total}$, divided by the area $F_{open}$ through which the suspension flows. Accordingly, the land area ratio should have a value in the range $$l < F_{total}/F_{open} < -0.0094 \cdot d_L[\text{mm}] + 2.16,$$

where $d_L$ is the baffle spacing in the nozzle at the end of the turbulence generator or, if there are no baffles, the initial nozzle height.

Based on the above explanation, a headbox has at least one first means for feeding stock suspension so that it is distributed over the machine width, at least one second means for generating turbulence, this/these second means being arranged downstream in the flow direction of the first means for feeding stock suspension, and at least one third means downstream in the flow direction of the means for generating turbulence for applying the stock suspension over the machine width to a wire or for introducing the stock suspension between two wires. At least one of the means, particularly, the second means for generating turbulence, has a hydraulic diameter $d_{hrydr}$ of less than 17 mm. This hydraulic diameter is preferably less than 14 mm, and most preferably 14–9 mm.

The configuration of the headbox, particularly of its turbulence generating region, advantageously has the effect that the growth of turbulent transverse movements is impeded by the smaller wall spacing. As a result, a considerable advantage can be established simply as a result of reducing the wall spacing in only one plane.

Furthermore, it is advantageous if the ratio of the turbulence energy that is caused by wall friction to the flow cross section of a turbulence generating unit increases as the hydraulic diameter decreases. In this way, the specific fine turbulence component is increased considerably, and disturbing turbulent transverse movements of greater extent are effectively dissipated. Because the fine turbulence is generated at a greater distance from the outlet nozzle, in comparison with the use of baffles, the decay time is considerably greater. This is true, in particular, because of the fact that the velocity along the flow path between the end of the baffles and the nozzle outlet is greater by at least a factor of 3 than at the start of the nozzle. Decay is understood here to mean the combination of a large number of turbulence spheres with a high frequency transverse movement of small extent to form those of lower frequency with a somewhat greater amplitude.

Some exemplary embodiments of the headbox, and in particular of the turbulence generating region of the headbox, are described.

One possible configuration of the turbulence generator is to form it exclusively from a large number of plates, which are arranged horizontally, vertically and/or obliquely. In this case, at least two flow guiding walls run parallel to each other, as viewed in a section transverse to the machine direction. According to the invention, the mutual spacing of the plates at the inlet side is less than 16 mm. The plate surface may be completely or partly structured to improve the turbulence generation. The cross-sectional course along the flow path may be of step like design. It is also possible for different plate shapes and/or spacings to alternate in a regular sequence. Likewise, the plates may end at different distances from the nozzle outlet gap.

In a further embodiment of the turbulence insert, having a large number of channels, the channels have hydraulic diameters in the outlet region of the channels of a maximum of 17 mm, and preferably 14 mm. This can be achieved, for example, by use of appropriately small individual tubes, channels with a high length/width ratio or else with relatively large tubes with built-in parts, at least in the outlet region. The tube walls are perforated. For example, they may be slotted parallel to the tube axis. These slots may extend over part of or over the entire tube length. In the latter case, the turbulence generator thus comprises a large number of webs which run parallel to one another but are not connected to one another. Likewise, the tube walls may have different lengths, as viewed in the flow direction. For example, the vertical walls can extend further into the following nozzle than the horizontal walls. This achieves a reduction in the land areas in the respective plane. Likewise, the ratio of the longer tube side to the shorter tube side of a rectangular turbulence tube may be greater than 1.8 at the tube outlet. In tubes having a side ratio greater than 1.8, the longer section runs horizontally. In this case, the pitch of the tube bundle is preferably less than 200 mm. Likewise, the tubes with a high side/length ratio may be fed, on the stock suspension feeding side, through a plurality of holes or through a slot. If the side/length ratio is less than 1.8, then the tube pitch is less than 20 mm. In a turbulence generator comprising rectangular tubes, the vertical tube sides are offset in relation to one another. It is also possible for different tube shapes to alternate in a regular sequence.

The features of the two above described designs of the turbulence generators can also be used in combination with each other.

In a further advantageous form of the turbulence generator, the turbulence tubes have the form of a static mixer. In this case, the hydraulic diameters are also preferably less than 17 mm. Reference here is made to German Application DE 42 11 291 from the applicant, which is incorporated by reference in the present description.

Another embodiment comprises designing the turbulence generator to be of a C-clamp construction, having a C-shaped supporting structure which engages around the stock suspension distribution. This has the advantage that the internal pressure that acts on the nozzle wall is led through the turbulence insert. A great advantage of this design principle is the short lever arm. This results in very low deformation of the nozzle outlet cap under operating conditions, which, as is known, is extremely important for an even fiber orientation angle profile. The C-construction may be realized, for example, even in the case of turbulence generators which are constructed from vertical plates or individual channels. In these latter applications, the nozzle forces are led through all or some of the vertical plates, or through the vertical walls of the channels, for the purpose of the force flow. It is also essential here that the hydraulic diameter of these plates be less than 17 mm at the outlet side of the turbulence generator.

In a turbulence generator with plates or channels, the latter may be completely or partly provided with structures, and particularly uniform turbulent transverse movements are achieved as a result of the corrugated plates. The corrugations of one side preferably run parallel, but the corrugations of mutually opposing sides may run parallel to one another or at an angle other than 0° in relation to one another. Reference is made to German Patent Application DE 44 33 445 of the applicant, incorporated by reference in the disclosure of the present description.

Furthermore, it is advantageous if the flow guidance in the turbulence inserts is such that a flow which is divergent in one or more dimensions is avoided.

It is also advantageous if the flow cross section is widened at a single location in the region of the turbulence insert, and this widening is preferably located in the inlet region of the turbulence insert.

Furthermore, following transverse webs, abrupt steps and other built-in parts in the turbulence insert which disturb the uniformity or coarsen the turbulence level, it is advantageous to produce hydraulic diameters in the nozzle which are in any case less than 17 mm.

A further advantageous design of the turbulence insert resides in configuring the baffles that are used for turbulence generation so that they are variable in length.

The above mentioned features of the headbox can also advantageously be used in a multilayer headbox.

The features of the invention described above and below can be used in the indicated combination but also in other combinations or on their own, within the scope of the invention.

Other features and advantages of the present invention will become apparent from the following description of the invention which refers to the accompanying drawings.

DESCRIPTION OF PREFERRED EMBODIMENTS OF THE INVENTION

Figure 1:
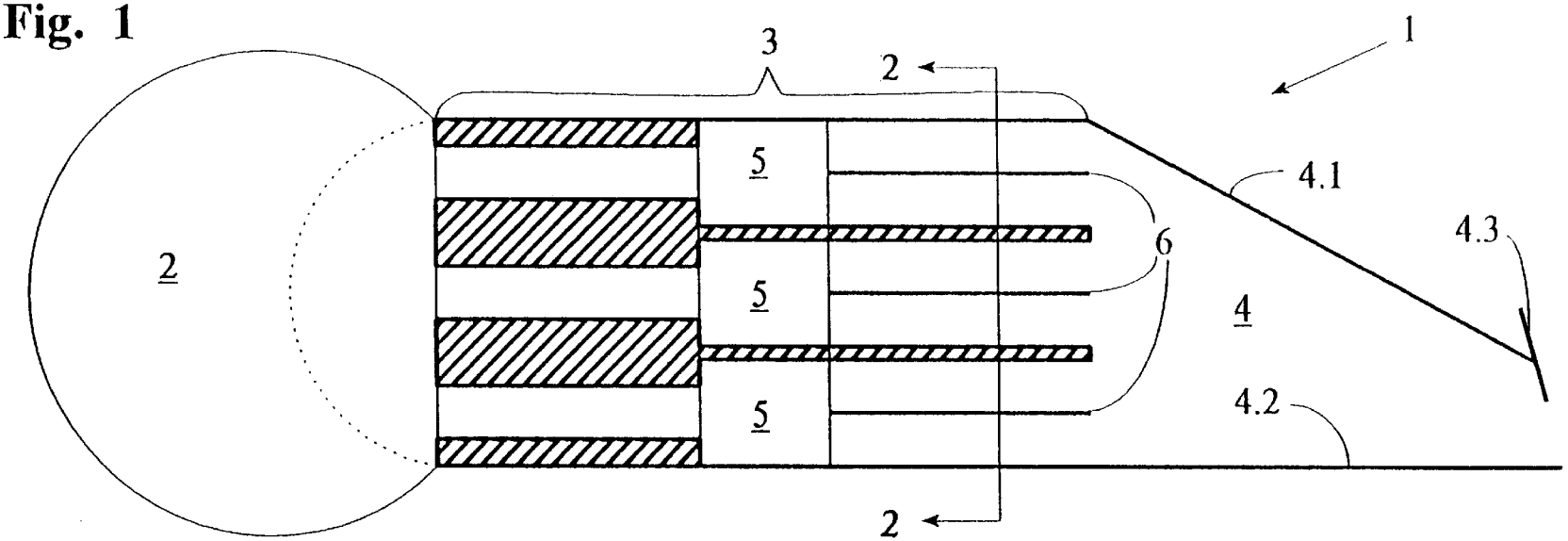
FIG. 1 schematically shows a longitudinal section through a headbox with a tube bundle turbulence generator having inserts for reducing the hydraulic diameter.

FIG. 1 shows a headbox 1 with a transverse distributor 2 at the inlet end, which feeds stock suspension into the downstream following turbulence generating region 3. From the turbulence generating region 3, the stock suspension is led further downstream into the nozzle 4. The nozzle 4 has a top lip 4.1 and a bottom lip 4.2, which converge downstream. The top lip 4.1 is equipped with a slice 4.3.

The turbulence generator 3 comprises a large number of tubes 5, which widen stepwise from their inlet regions to their outlet regions.

According to the invention, additional crosses, comprised of horizontal and vertical orientation surfaces 6, are fitted in the outlet end region of the turbulence tubes, i.e., they are shown to the right or outlet end region of the generator 3. These crosses ensure that the hydraulic diameter of the turbulence generator is significantly reduced in the outlet end region. This is caused by the length of the edge regions that come into contact with the suspension being increased at the end of the turbulence generator. The hydraulic diameter $d_{hydr}$ is calculated as follows:

$$d_{hydr}=4\cdot F_{hydr}/L_{hydr},$$

where:

$F_{hydr}$=Total cross-sectional area through which fluid flows $L_{hydr}$=Length of all edge regions which occur and come into contact with the suspension.

Figure 2:
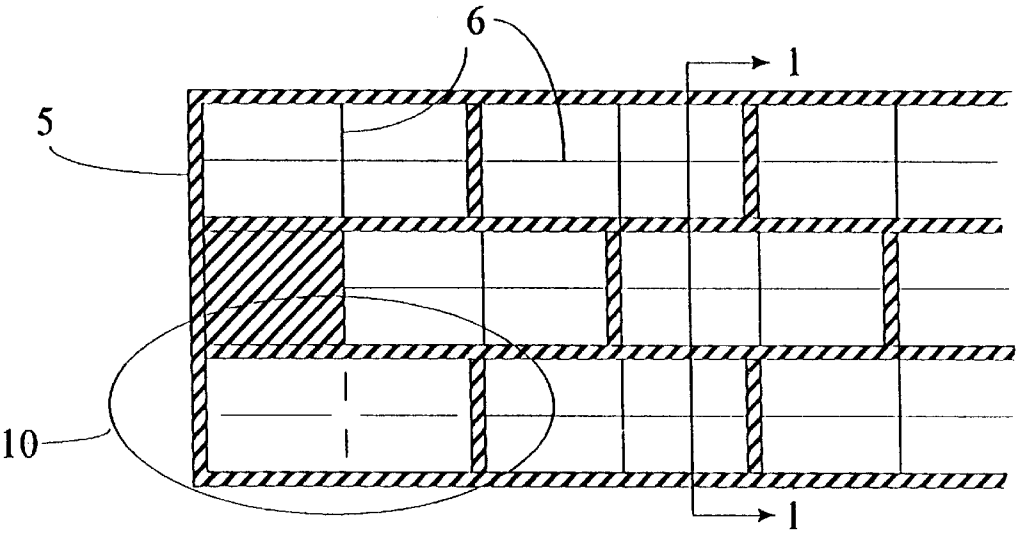
FIG. 2 shows section B—B from FIG. 1.

FIG. 2 shows the section along line B—B in FIG. 1. The individual tubes 5 have rectangular contours, which are arranged offset and in several rows. There are surfaces 6 in the rectangular tubes which form crosses and which are arranged centrally in the rectangular tube 5 of the turbulence generator. With a virtually constant area through which fluid flows, the overall length of the edge regions that come into contact with the suspension is increased, so that a corresponding reduction in the hydraulic diameter $d_{hydr}$ in the end region of the turbulence generator is also brought about.

The illustrated design of the crosses, which are located in the tubes and include the surfaces 6, can also be implemented such that the surfaces 6 do not touch the walls of the tubes and/or have a cutout in their intersecting region. An exemplary illustration is given in the circle designated by 10.

Furthermore, there is also the possibility of providing the surfaces 6 in their end region with a slightly turned over edge, so that the flow is imparted an additional rotational component.

Figure 3:
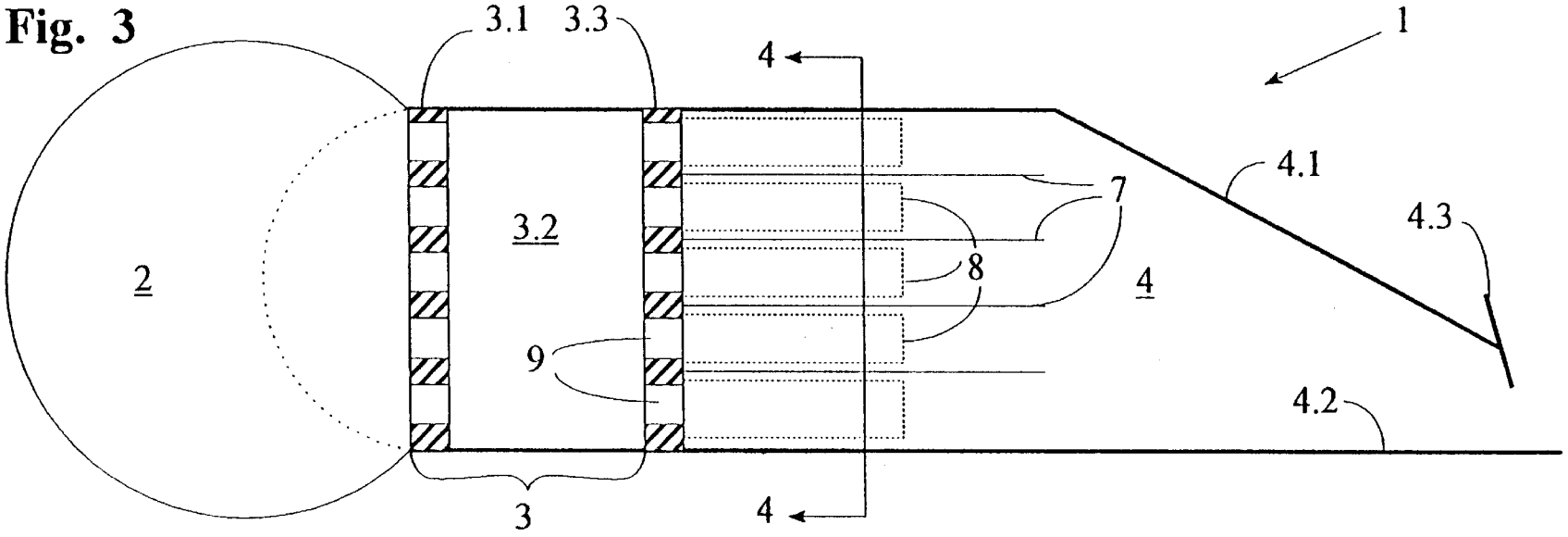
FIG. 3 schematically shows a longitudinal section through a headbox embodiment having a turbulence generator with an equalization chamber and means for reducing the hydraulic diameter.

FIG. 3 shows another inventive headbox 1 with a transverse distributor 2. From the transverse distributor 2, the stock suspension is guided via a tubular distribution grating 3.1 into an intermediate channel 3.2. After the intermediate channel 3.2, the stock suspension passes via a further tubular distribution grating 3.3, having a large number of openings 9, into a further turbulence generating region. This region comprises a large number of horizontal walls 7 and vertical walls 8 that are arranged at right angles to each other. The walls 8, which are vertical in relation to the machine width, are of shorter length downstream than the walls 7, that are arranged horizontally. A design with the converse length arrangement, or one having walls 7 and 8 of identical lengths, is also possible. In all these designs, it is essential that, in the end region of the turbulence generator, the hydraulic diameter is less than 17 mm, or lies within the range of the formula:

$$6\text{ mm}\leq d_{hydr}[\text{mm}]\leq -0.52\ d_D[\text{mm}]+30,$$

where $d_D$=nozzle height at half the nozzle length [mm]·0.5.

Figure 4:
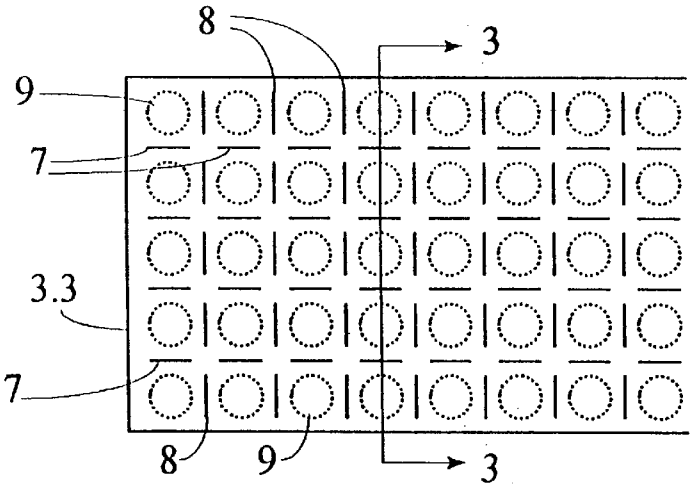
FIG. 4 shows section B—B from FIG. 3.

FIG. 4 illustrates the section line at B—B of FIG. 3, which passes through the vertical and horizontal walls 8 and 7. As can be seen in FIG. 4, the walls 8 and 7 do not touch each other in this embodiment. However, it is also within the invention to permit the walls 7 and 8 to intersect over the entire length or only partially.

In this embodiment, it is particularly advantageous that the land-area ratio at the end of the turbulence generator can be kept very low, or that it lies within the range of the following formula:

$$l<F_{total}/F_{open}<-0.0094\cdot d_L+2.16$$

$d_L$=greatest baffle spacing in the nozzle or, if there are no baffles, the greatest nozzle height $F_{total}$=total cross-sectional area at the end of the turbulence generator $F_{open}$=open passage area at the end of the turbulence generator.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for a paper or board machine, wherein the machine has a width direction and the headbox extends across the width direction, the headbox comprising:

the headbox having an inlet end, a distributor at the inlet end for feeding stock suspension over the machine width;

at least one turbulence generator in the headbox downstream from the distributor in the stock suspension flow direction, the turbulence generator having a downstream end region with a hydraulic diameter $d_{hydr}$ of less than 17 mm, and wherein the hydraulic diameter at its largest has a value such that:

$6\text{ mm} \leqq d_{hydr} \leqq -0.52\, d_D + 30$, where $d_D$=nozzle height at half the nozzle length 0.5;

a nozzle downstream of the turbulence generator for receiving suspension from the turbulence generator and for applying the suspension over the width direction of the machine to a wire or wires for receiving the suspension from the nozzle.

2. The headbox of claim 1, wherein the turbulence generator end region has a hydraulic diameter of less than 14 mm.

3. The headbox of claim 1, wherein the turbulence generator has a hydraulic diameter that is in the range of 14 mm to 5 mm.

4. The headbox of claim 1, wherein the turbulence generator has a hydraulic diameter that is in the range of 14 mm to 9 mm.

5. The headbox of claim 1, wherein the turbulence generator has a downstream end in the flow direction of stock suspension through the turbulence generator, has lands at the downstream end and has open regions defined by the lands, wherein the land-area ratio at the end of the turbulence generator lies in the range $$l < F_{total}/F_{open} < (-0.0094.d_L) + 2.16$$

where:

l=land area ratio $d_L$=greatest baffle spacing in the nozzle or, if there are no baffles, the greatest nozzle height, $F_{total}$=total cross-sectional area at the end of the turbulence generator, $F_{open}$=open passage area at the end of the turbulence generator.

6. The headbox of claim 5, wherein the turbulence generator has at least two machine width channels extending in the flow direction of the stock suspension.

7. The headbox of claim 1, wherein the turbulence generator has at least two machine width channels extending in the flow direction of the stock suspension.

8. The headbox of claim 1, wherein the turbulence generator comprises a plurality of channels arrayed in rows next to each other and rows above each other, the channels being oriented in the direction of flow of stock suspension through the turbulence generator.

* * * * *